US007178670B2

(12) United States Patent
Chen

(10) Patent No.: US 7,178,670 B2
(45) Date of Patent: Feb. 20, 2007

(54) TOOL RETAINING SEAT

(76) Inventor: Chang-Ying Chen, 235 Chung - Ho Box 8-24, Taipei (TW)

( * ) Notice: Subject to any disclaimer, the term of this patent is extended or adjusted under 35 U.S.C. 154(b) by 0 days.

(21) Appl. No.: 11/251,211

(22) Filed: Oct. 17, 2005

(65) Prior Publication Data

US 2006/0096878 A1 May 11, 2006

(51) Int. Cl.
*B65D 85/28* (2006.01)

(52) U.S. Cl. ..... 206/376; 206/806; 211/70.6

(58) Field of Classification Search ..... 206/372–378, 206/477, 806; 211/70.6
See application file for complete search history.

(56) References Cited

U.S. PATENT DOCUMENTS 3,370,696 A * 2/1968 Groe ..... 206/376
6,126,004 A * 10/2000 Ling ..... 206/377
6,315,121 B1 * 11/2001 Hansen ..... 206/376
6,401,923 B1 * 6/2002 Huang ..... 206/376
6,758,350 B2 * 7/2004 Lin ..... 211/70.6
6,976,582 B2 * 12/2005 Chen ..... 206/376

* cited by examiner

*Primary Examiner*—Luan K. Bui

(57) ABSTRACT

A tool retaining seat comprises a cover unit; an upper end of the cover having a hole; the cover being extended with two clamping plates; each clamping plate including a plurality of hollow clamping portions; an adjusting unit received in a lower end of the cover unit; an upper end of the cover unit being an adjusting portion; and a bottom side of the adjusting unit having two inclined slide slots; two positioning plates; each clamping plate receiving a positioning plate; a front end of each positioning plate having a projection; each positioning plate having a plurality of hooks; the hooks of the positioning plate and the hooks of the clamping portion serving to clamp the tools placed on the clamping portion. When adjusting unit moves, the positioning plate will move in the clamping plate so that the hooks of the positioning plate.

9 Claims, 9 Drawing Sheets

TOOL RETAINING SEAT

FIELD OF THE INVENTION

The present invention relates to hand tools, and in particular to a tool retaining seat which can be located within a tool box or placed upon a display plate for exhibition. Furthermore, the tools are retained therein firmly and can be taken out easily.

BACKGROUND OF THE INVENTION

Currently, tools are placed upon a tool retaining seat. Then the tool retaining seat can be located on a display plate for exhibition or the tool retaining seat is placed in a tool box for storage. Thus it provides the users with various applications and convenience in use of these tools.

In one prior art, a tool frame is used to locate tools. The tool frame has a plurality of grooves for embedding a plurality of tools tightly therein. However this prior art design is not useful in the exhibition of the tools. Thereby it is difficult to take the tool. When it is used for many times, the frame will become loose or the tools wear. As a result, the tools easily fall out. As a whole, it is not practical and useful.

SUMMARY OF THE INVENTION

Accordingly, the primary object of the present invention is to provide a tool retaining seat which can be located within a tool box or placed upon a display plate for exhibition. Furthermore, the tools are retained therein firmly and can be taken out easily.

To achieve above objects, the present invention provides a tool retaining seat. The tool retaining seat comprises a cover unit being a hollow casing; an upper end of the cover having a hole; the cover being extended with two clamping plates; each clamping plate including a plurality of hollow clamping portions; all the hollow clamping portions being communicated; an adjusting unit received in a lower end of the cover unit; an upper end of the cover unit being an adjusting portion; thereby the adjusting unit being moved by moving the adjusting portion; and a bottom side of the adjusting unit having two inclined slide slots; two positioning plates; each clamping plate receiving a positioning plate; a front end of each positioning plate having a projection; the moving direction of the adjusting unit being vertical to that of the positioning plates; each positioning plate having a plurality of hooks; the hooks of the positioning plate with the hooks of the clamping portion serving to clamp the tools placed on the clamping portion; when the adjusting unit being moved, the positioning plate will move horizontally in the clamping plate so that the hooks of the positioning plate.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
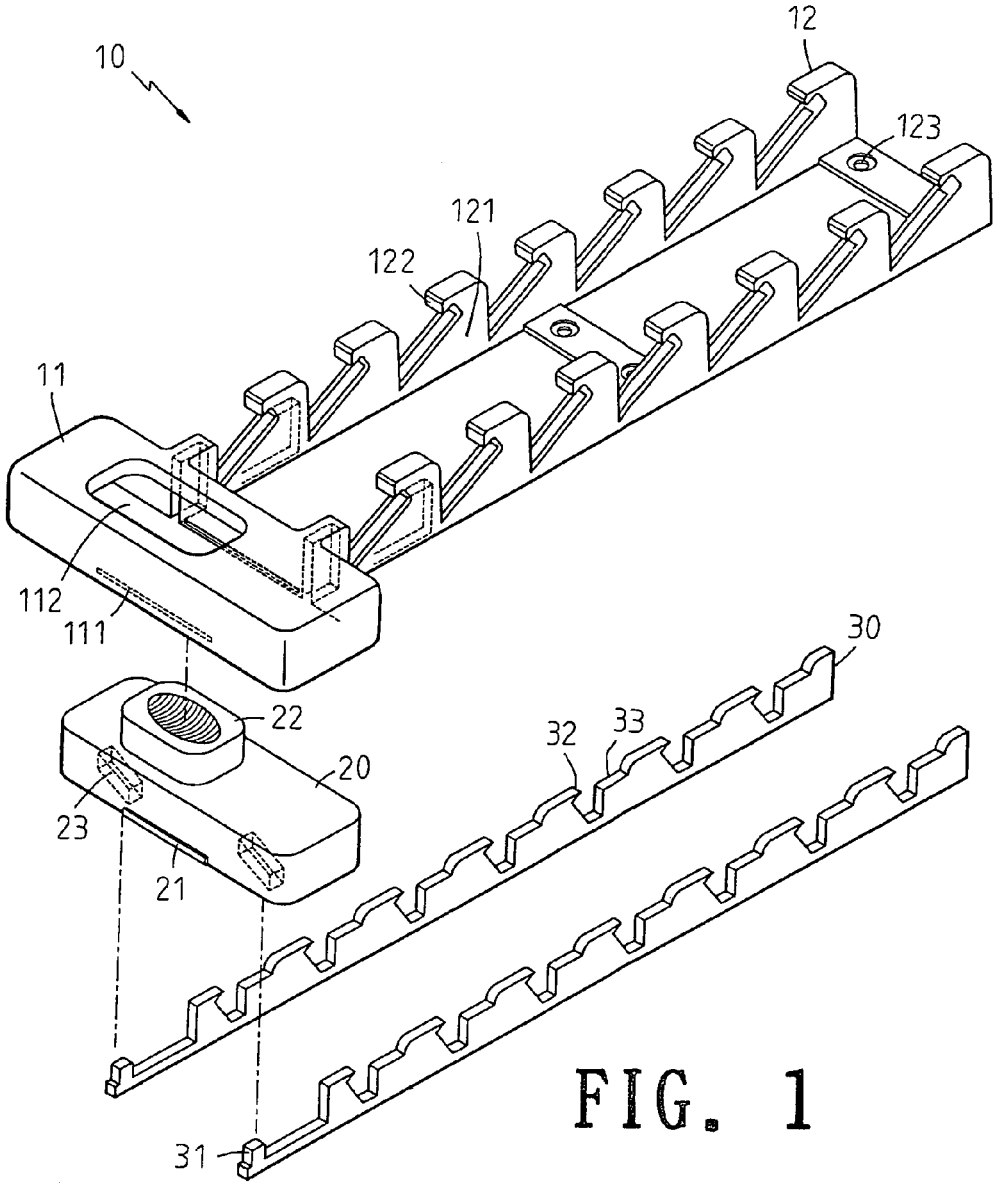
FIG. 1 is an exploded perspective view of the tool retaining seat of the present invention.
Figure 2:
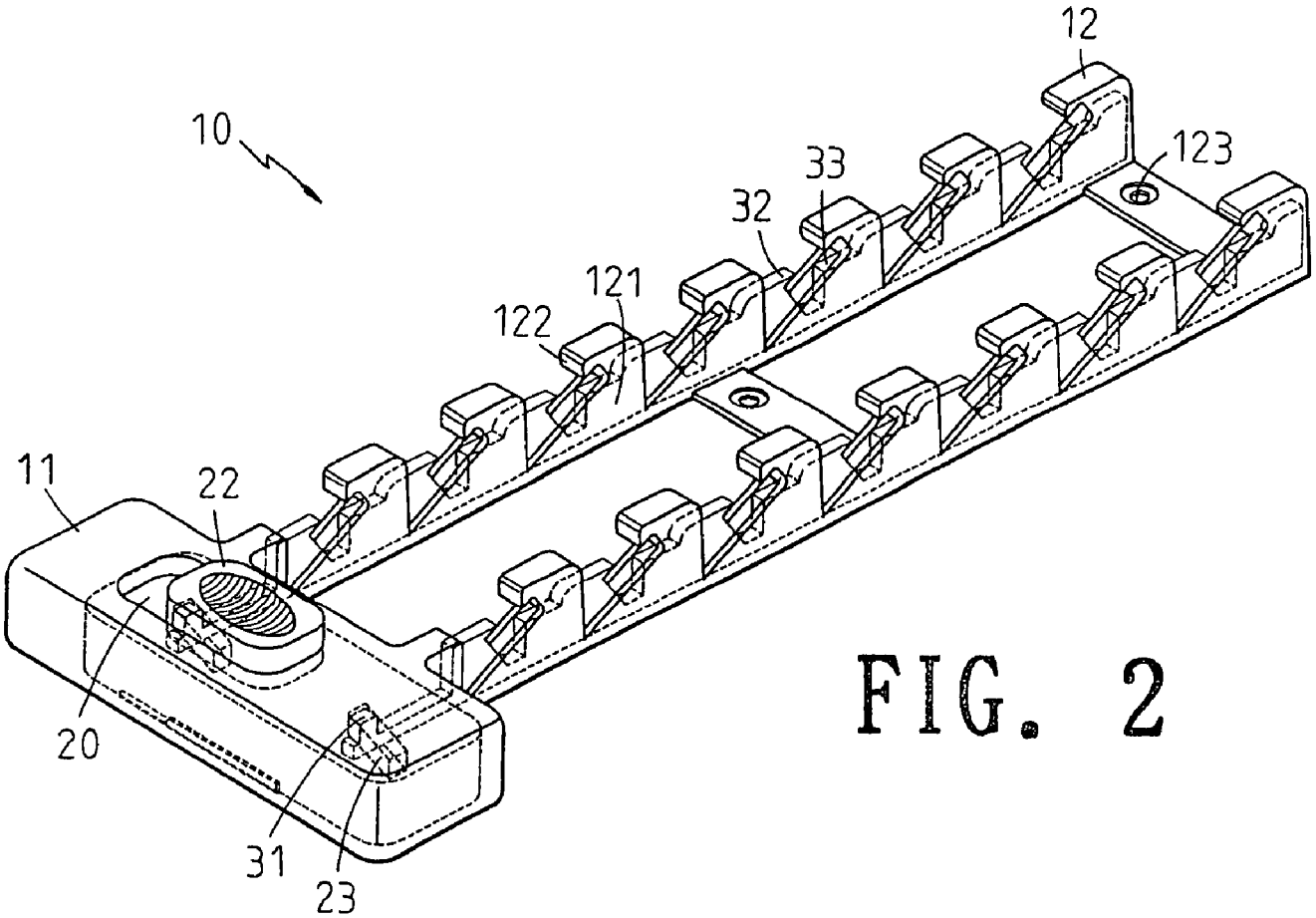
FIGS. 2 and 3 are perspective views of the present invention.
Figure 3:
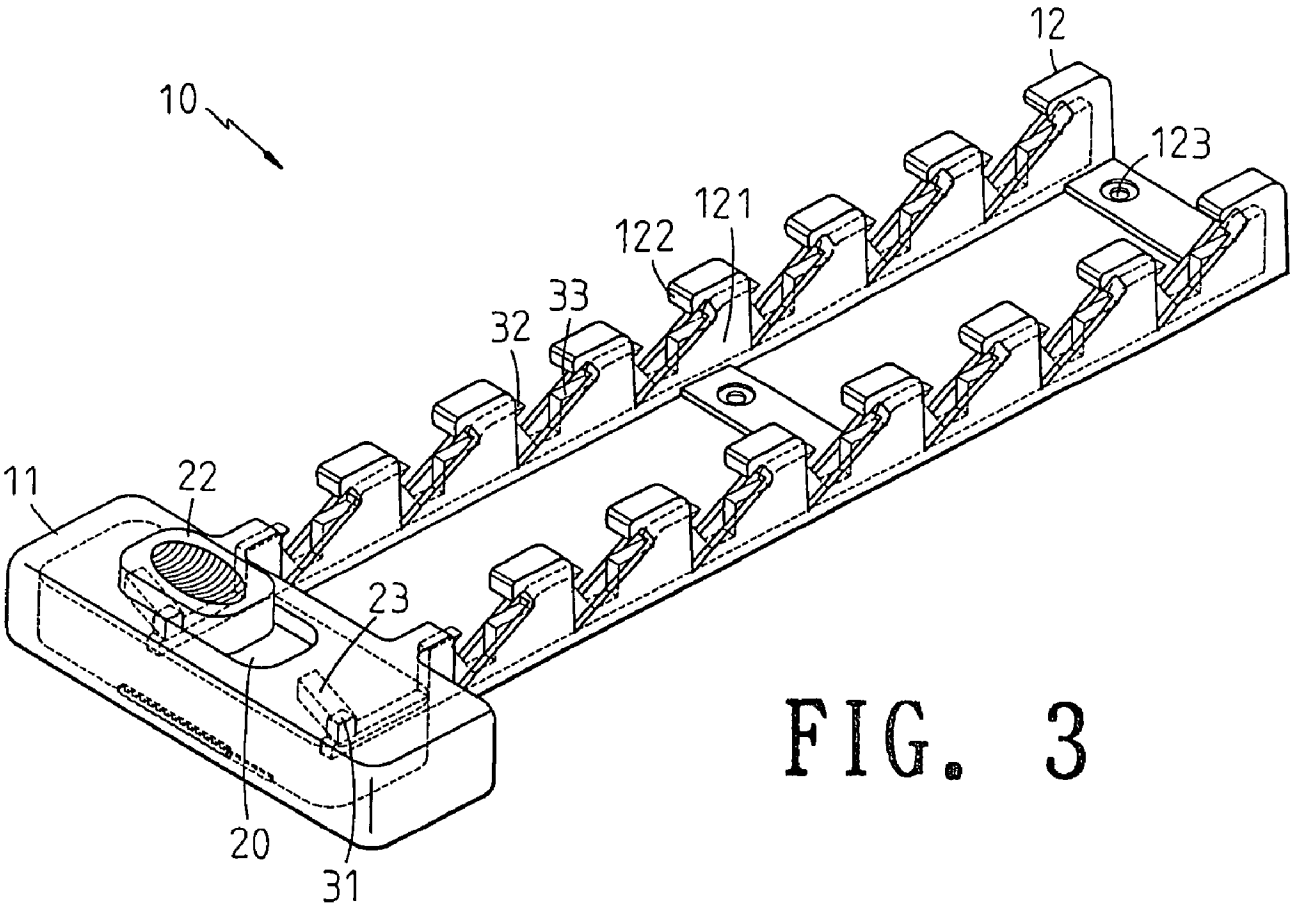

Referring to FIG. 1 to 3, the tool retaining seat of the present invention is illustrated. The present invention has the following elements.

A seat body 10 has a cover unit 11. The cover unit 11 is a hollow casing. An upper end of the cover 11 has a hole 112. The cover 11 is extended with two clamping plates 12. Each clamping plate 12 includes a plurality of hollow clamping portions 121. All the hollow clamping portions 121 are communicated. Thereby the clamping portions 121 can be used for locating tools. Each clamping portion 121 has an approximate triangular shape. A top of each clamping portion 121 has a hook 122. A plurality of connecting plates serves to connect the two clamping plates 12. A plurality of threaded holes 123 are formed in the connecting plates for positioning and locking. A bottom end of the cover unit 11 is formed with a receiving groove 111.

An adjusting unit 20 is received in a lower end of the cover unit 11. A lateral side of the adjusting unit 20 is protruded with a buckling rib 21 capable of being received within the receiving groove 111. The adjusting unit 20 is shorter than the cover unit 11. An upper end of the cover unit 11 is an adjusting portion 22. The adjusting portion 22 protrudes out of the hole 112. Thereby the adjusting unit 20 is moved by moving the adjusting portion 22. A bottom side of the adjusting unit 20 has two inclined sliding slots 23.

Two positioning plates 30 are included. Each clamping plate 12 receives a positioning plate 30. The hook 122 with the positioning plate 30 has the function of clamping the tool placed upon the clamping portion 121. A front end of each positioning plate 30 has a projection 31. The moving direction of the adjusting unit 20 is vertical to that of the positioning plates 30. Each positioning plate 30 has a plurality of hooks 32. The hooks 32 of the positioning plate 30 with the hooks 122 of the clamping portion 121 serve to clamp the tools placed on the clamping portion 121. A lateral side of each hook 32 of the positioning plate 30 is formed with an ejection portion 33 for pushing a tool on the clamping portion 121 outwards. When the adjusting unit 20 moves, the positioning plate 30 will move horizontally in the clamping plate 12 so that the hooks 33 of the positioning plate 30 and the ejection portions 33 will be received within the clamping portion 121, as shown in FIG. 2. If the hook 32 protrudes from the front end of the clamping portion 121, the hooks 32 of the positioning plate 30 and the hooks 122 of the clamping portion 121 will clamp the tools placed upon the clamping portion 121 from two lateral sides so as to fix the tools. Referring to FIG. 3, when the ejection portions 33 protrude from the bottom end of the clamping portion 121, the tools upon the clamping portion 121 will be pushed out.

Figure 4:
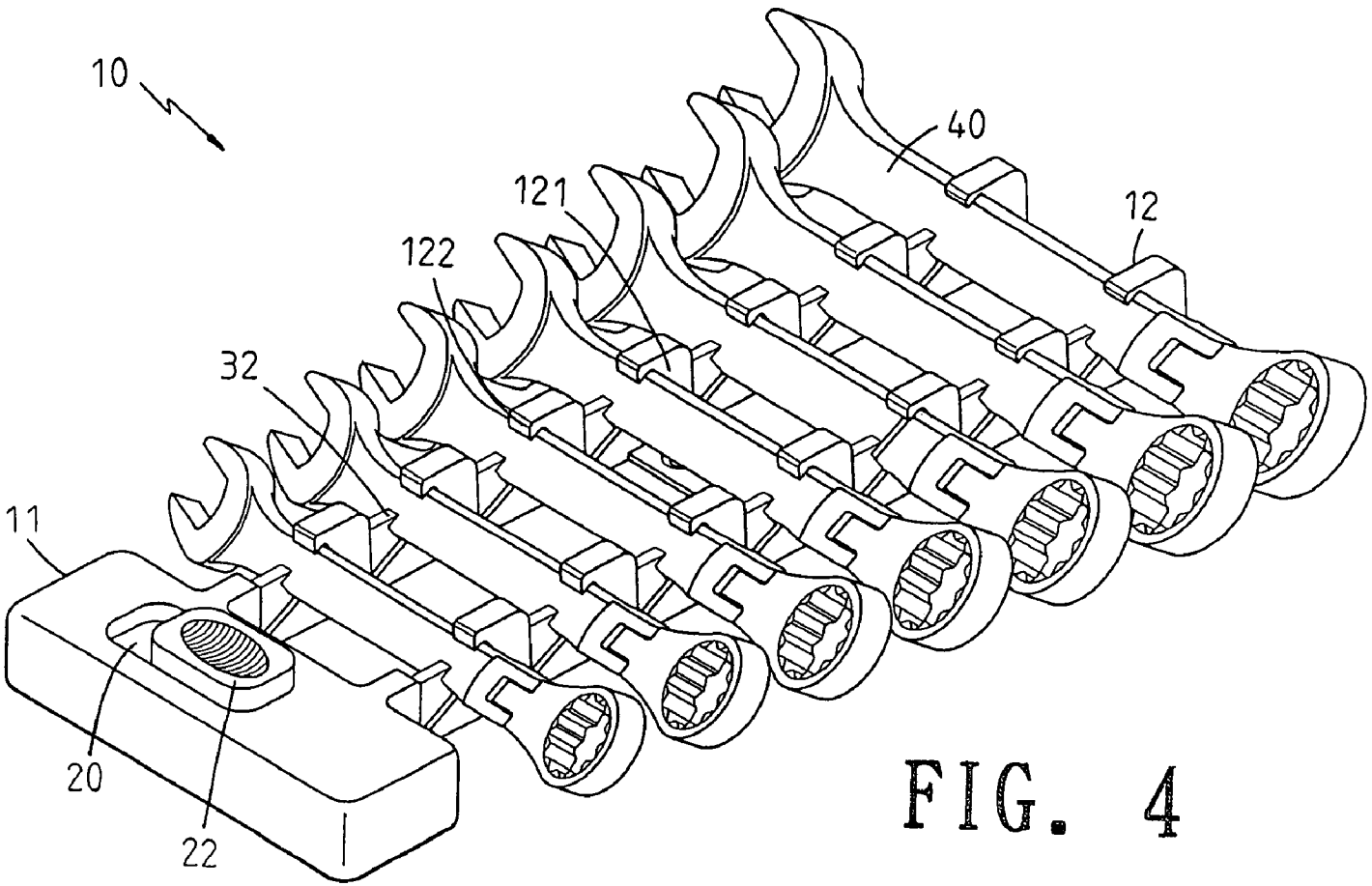
FIGS. 4 and 5 are schematic views about the tool retaining seat of the resent invention.
Figure 7:
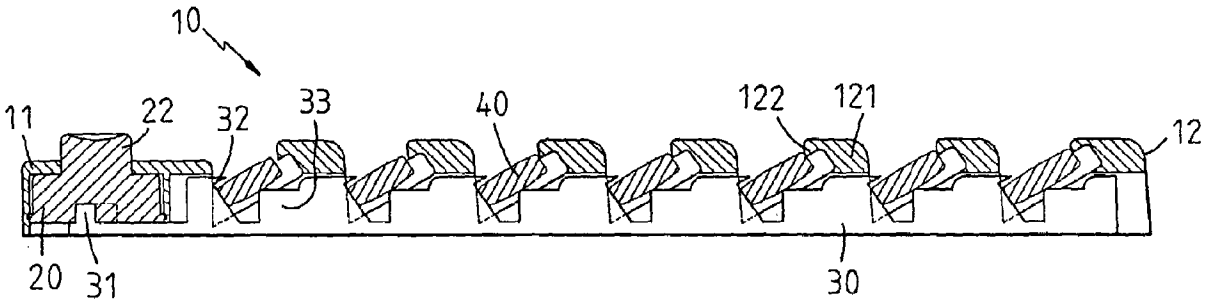

Referring to FIGS. 4 and 7, in use of the present invention, tools can be placed upon the clamping portions 121. In this embodiment, a plurality of spanners 40 are placed upon the clamping portions 121. When the spanners 40 are placed upon the clamping portions 121, referring to FIG. 4, the adjusting unit 20 is moved backwards so that the projection 31 of the positioning plate 30 is placed into the sliding slot 23 of the adjusting unit 20 at a position near the clamping plate 12. Thereby the projections 31 of the positioning plates 30 are driven by the inclined sliding slots 23 of the adjusting unit 20 to slide toward the distal ends of the clamping plates 12 of the positioning plate 30. Then the hooks 122 of the clamping portions 121 protrude from the clamping portion 121. Thereby the spanners 40 are clamped at two sides by the hooks 122 of the clamping portions 121 and the hooks 32 of the positioning plates 30 so that the spanners 40 are firmly secured in the clamping portions 121.

Figure 5:
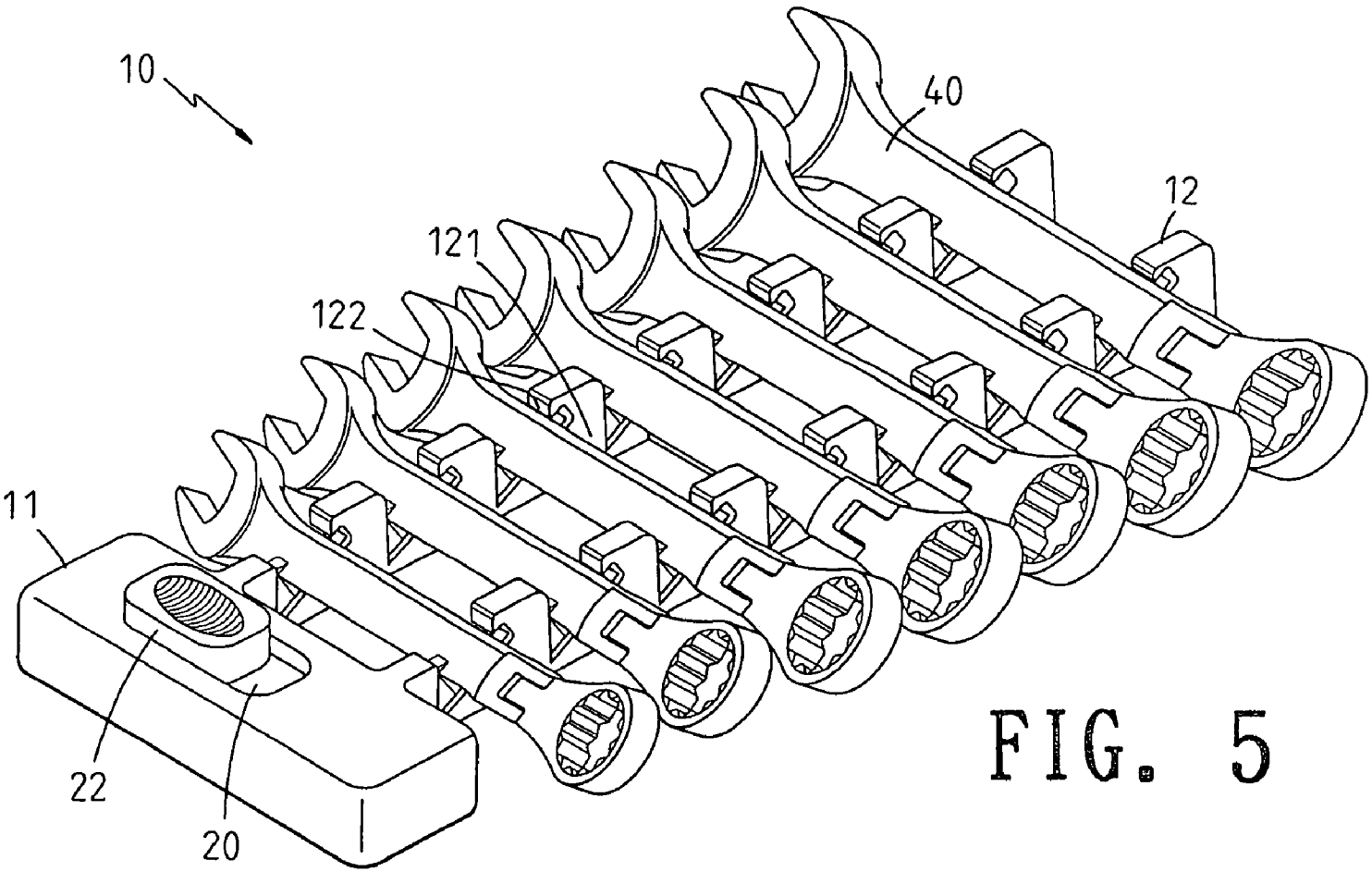
Figure 6:
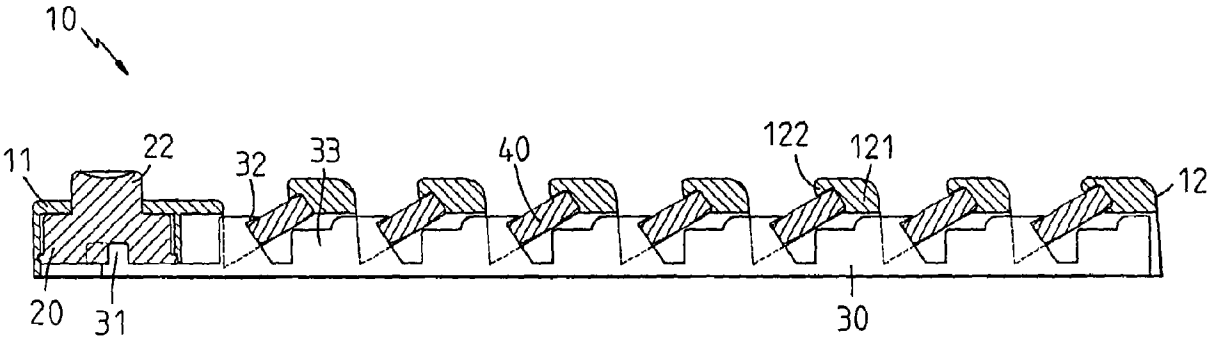
FIGS. 6 and 7 show the operations of the present invention.

If it is desired to take out the spanners 40, the adjusting unit 20 can be moved forwards from the adjusting portion 22, as shown in FIG. 5. Thereby the projections 31 of the positioning plates 30 are in the sliding slots 23 at positions far away from the clamping plates 12. Thereby the positioning plates 30 are driven to slide toward the cover unit 11. Thus, the hooks 32 of the positioning plates 30 will reduce into the clamping portions 121 and the ejection portions 33 protrude from the clamping portions 121 to push outwards slightly, as shown in FIG. 7. Therefore, the spanners 40 upon the clamping portions 121 are not clamped by the hooks 32 of the positioning plates 30 and the hooks 122 of the clamping portions 121 and are pushed by the ejection portions 33. Thereby the user can take out the tool.

Figure 8:
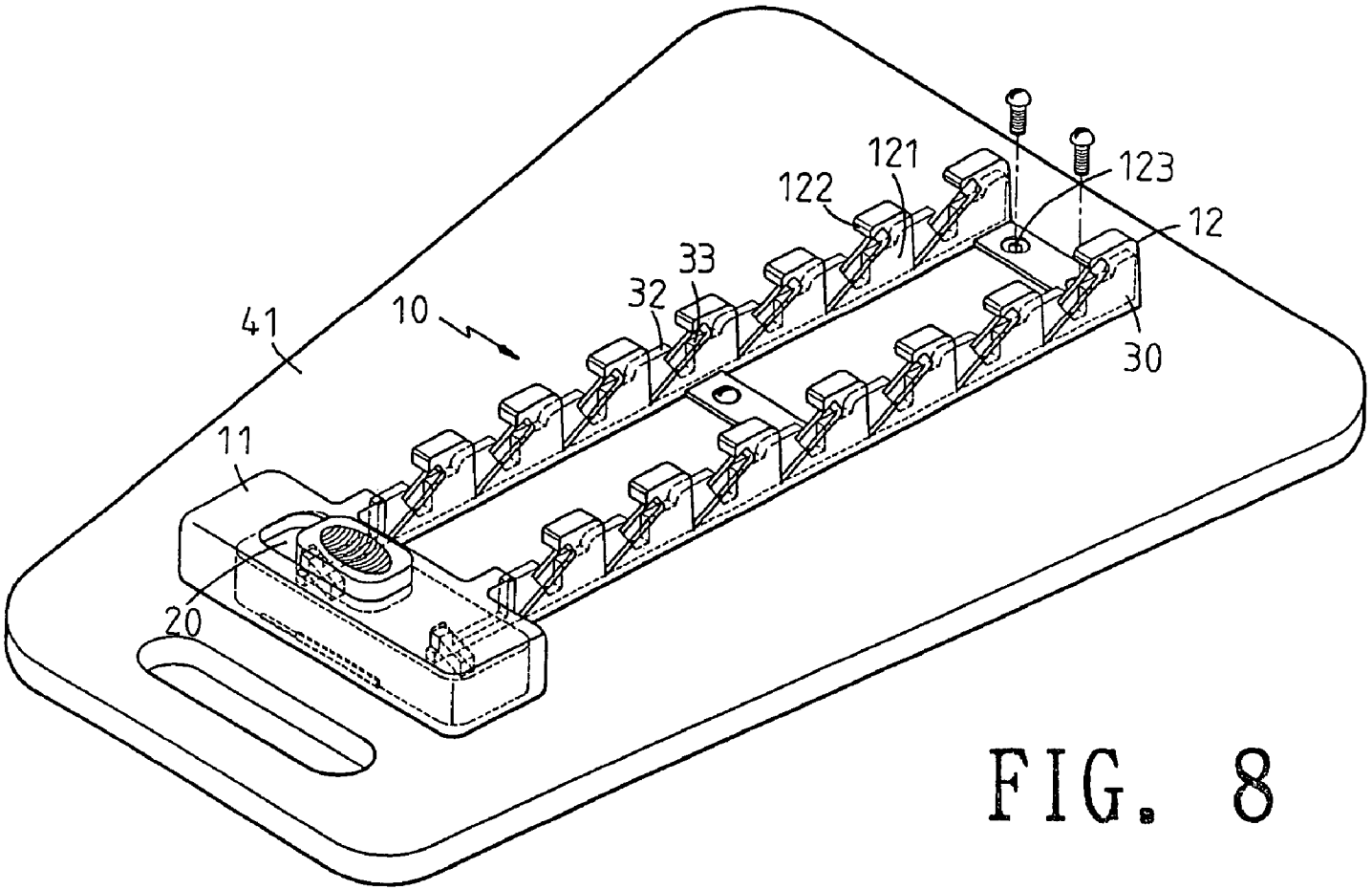
FIG. 8 is a perspective view showing that the present invention is installed with a display plate.
Figure 9:
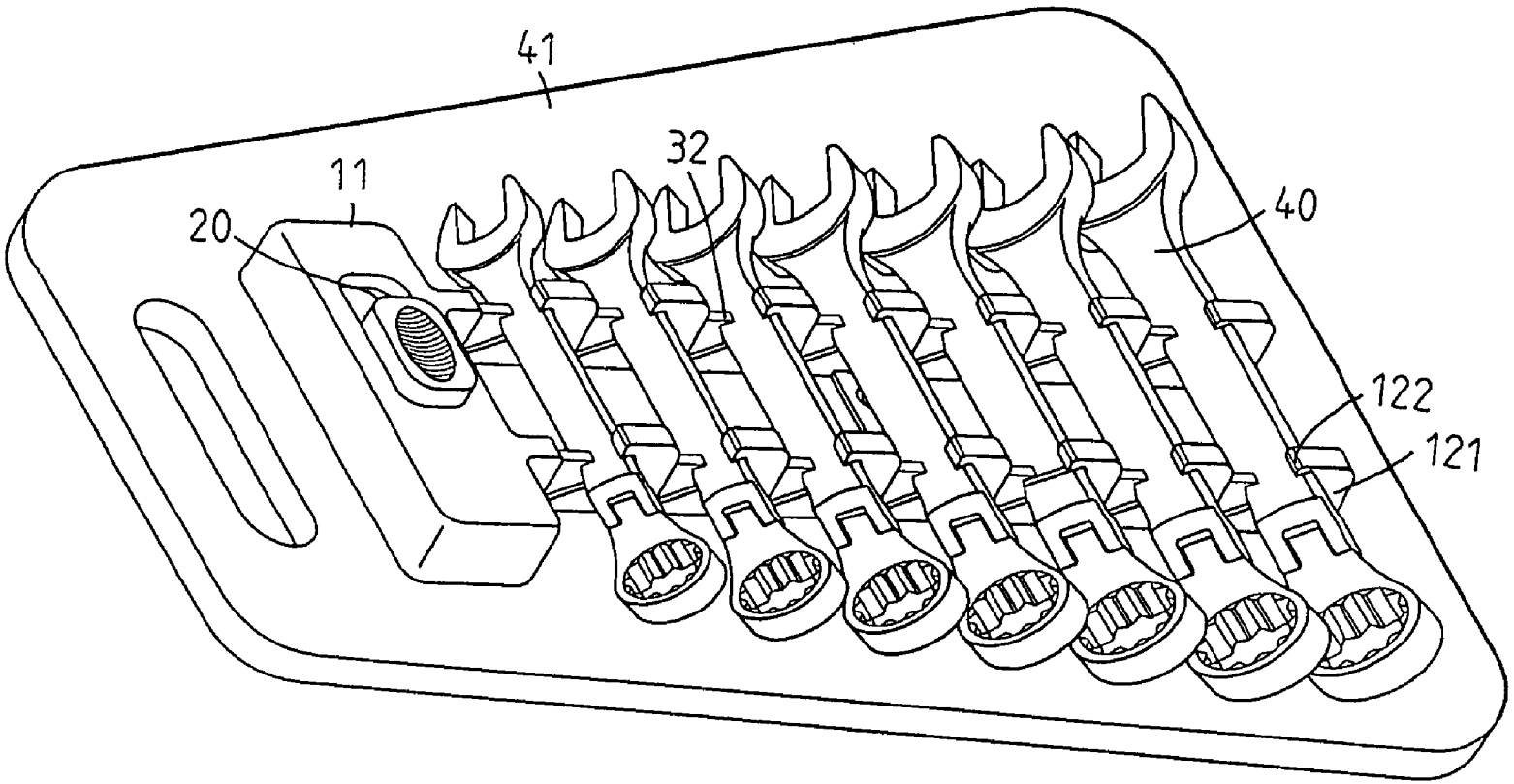
FIG. 9 is a schematic view showing that the present invention is installed with a display plate.

Referring to FIGS. 8 and 9, in the present invention, a plurality of threaded holes 123 on the seat body 10 serve to lock the seat body 10, adjusting unit 20 and the positioning plates 30 to a display plate 41. The spanners 40 are clamped by the hooks 32 of the positioning plates 30 and the hooks 122 of the clamping portions 121. Thereby the spanner can be displayed.

Figure 10:
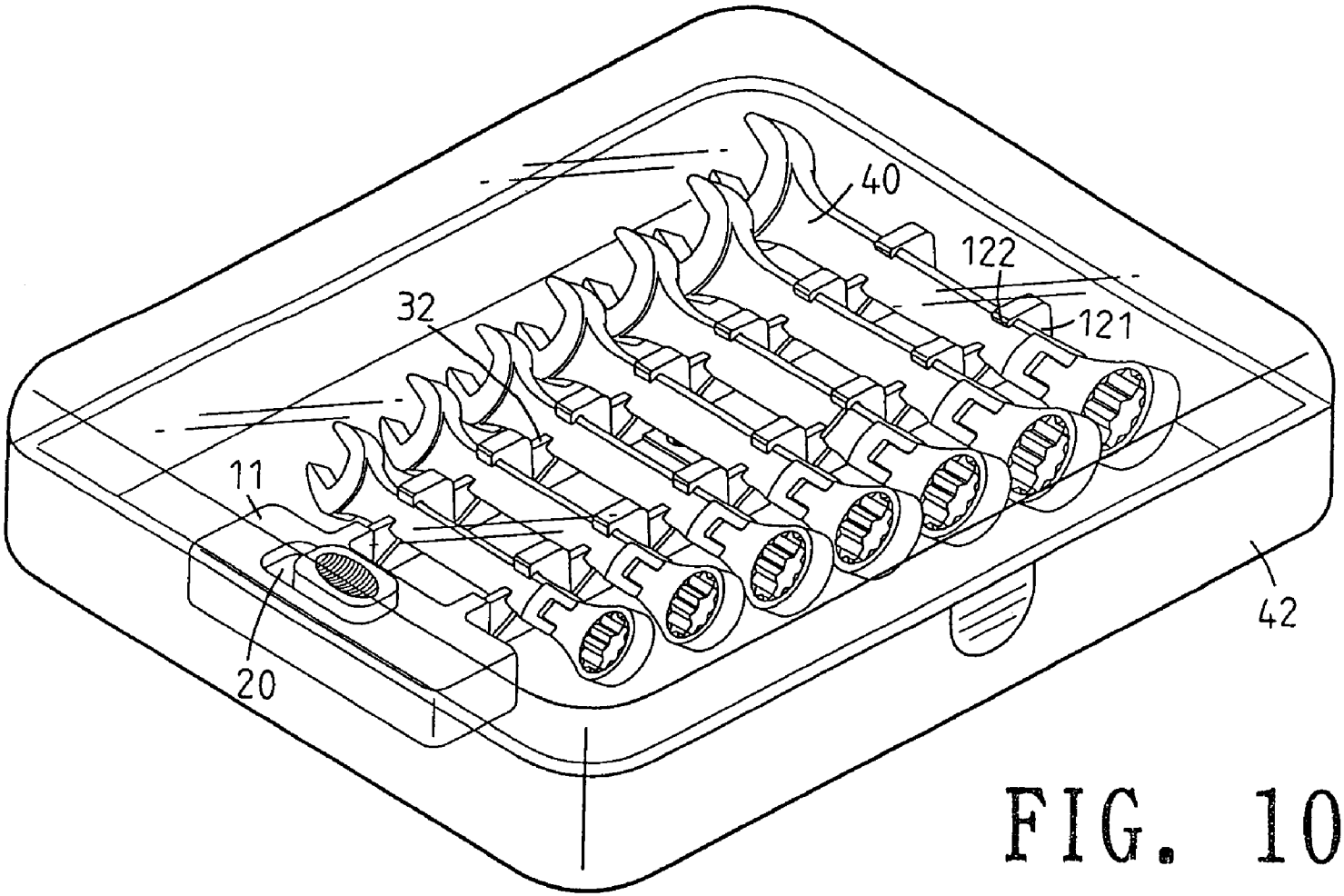
FIG. 10 is a schematic view showing that the present invention is used to a tool box.

Referring to FIG. 10, the present invention can be locked to a tool box 42 for positioning tools and displaying the tools.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A tool retaining seat comprising:

a cover unit being a hollow casing; an upper end of the cover unit having a hole; the cover unit being extended with two clamping plates; each clamping plate including a plurality of hollow clamping portions; all the hollow clamping portions being communicated;

an adjusting unit received in a lower end of the cover unit; the upper end of the cover unit being an adjusting portion; thereby the adjusting unit being driven to move by moving the adjusting portion; and a bottom side of the adjusting unit having two inclined sliding slots;

two positioning plates; the each clamping plate receiving a positioning plate; a front end of each positioning plate having a projection; the moving direction of the adjusting unit being vertical to that of the positioning plates; the each positioning plate having a plurality of hooks; the hooks of the positioning plate with hooks of the clamping portion serving to clamp the tools placed on the clamping portion; when the adjusting unit moves, the positioning plate will move in the clamping plate;

wherein when the hook protrudes from a front end of the clamping portion, the hooks of the positioning plate and the hooks of the clamping portion will clamp the tools placed upon the clamping portion from two lateral sides so as to fix the tools.

2. The tool retaining seat as claimed in claim 1, wherein a lateral side of each hook of the positioning plate is formed with an ejection portion for pushing a tool on the clamping portion outwards; when the adjusting unit moves, the positioning plate will move horizontally in the clamping plate so that the hooks of the positioning plate and the ejection portions will be received within the clamping portion.

3. The tool retaining seat as claimed in claim 1, wherein the adjusting portion protruding out of a hole of the cover unit.

4. The tool retaining seat as claimed in claim 1, wherein; the projections of the positioning plates are positioned in the sliding slots; when the adjusting unit moves, the projections are driven by the sliding slots; the moving direction of the positioning plates is vertical to that of the adjusting unit.

5. The tool retaining seat as claimed in claim 1, wherein a bottom end of the cover unit is formed with a receiving groove; and lateral side of the adjusting unit is protruded with a buckling rib capable of being received within the receiving groove.

6. The tool retaining seat as claimed in claim 1, wherein each clamping portion has an approximate triangular shape.

7. The tool retaining seat as claimed in claim 1, wherein a plurality of connecting plates serves to connect the two clamping plates; and plurality of threaded holes are formed in the connecting plates for positioning and locking.

8. The tool retaining seat as claimed in claim 1, wherein the the tool retaining seat is installed with a display plate.

9. The tool retaining seat as claimed in claim 1, wherein the tool retaining seat is located in a tool box.

* * * * *